US006142854A

United States Patent [19]

Remley et al.

[11] Patent Number: 6,142,854

[45] Date of Patent: Nov. 7, 2000

[54] DEBURRING SYSTEM AND METHOD FOR USING SAME

[75] Inventors: Fred K. Remley, Blue Grass; Jan C. Mangelsen, Charlotte, both of Iowa

[73] Assignee: Genesis SystemsGroup Ltd, Davenport, Iowa

[21] Appl. No.: 09/470,699

[22] Filed: Dec. 23, 1999

[51] Int. Cl.[7] ..... B24B 1/00

[52] U.S. Cl. ..... 451/57; 451/242; 451/246

[58] Field of Search ..... 451/28, 49, 51, 451/57, 59, 177, 178, 242, 241, 243, 245, 246, 65, 66, 41, 53, 54, 58, 103, 109, 112, 111, 251; 15/88, 88.3, 104.04

[56] References Cited

U.S. PATENT DOCUMENTS

| | | | |
|---|---|---|---|
| 4,373,296 | 2/1983 | Kobayashi | 451/65 |
| 4,893,642 | 1/1990 | Parslow et al. | 134/66 |
| 5,062,177 | 11/1991 | Huhmann | 15/88.2 |
| 5,105,583 | 4/1992 | Hammond et al. | 451/271 |
| 5,129,122 | 7/1992 | Shafer et al. | 451/209 |
| 5,468,173 | 11/1995 | Winton, III | 451/59 |
| 5,658,187 | 8/1997 | McCoy | 451/49 |
| 5,759,089 | 6/1998 | McCoy | 451/49 |
| 5,921,848 | 7/1999 | Zang et al. | 451/184 |

*Primary Examiner*—Derris H. Banks
*Attorney, Agent, or Firm*—Zarley, McKee, Thomte, Voorhees & Sease

[57] ABSTRACT

A deburring head is mounted on a frame for movement toward and away from a workpiece also mounted on the frame. The deburring head includes a plurality of deburring brushes which are rotated and which are adapted to engage the workpiece and remove burrs from the workpiece.

10 Claims, 4 Drawing Sheets

DEBURRING SYSTEM AND METHOD FOR USING SAME

BACKGROUND OF THE INVENTION

The present invention relates to a deburring system and method for using same.

In the manufacture of many articles it is desirable to use rotating wire brushes to deburr rough surfaces, milled edges, and welds at various locations on the work piece. An example of such a work piece is a camshaft which requires after its initial construction the deburring of rough surfaces thereon. Other metal work pieces also require this deburring step.

Therefore a primary object of the present invention is the provision of a deburring system and method for using same.

A further object of the present invention is the provision of a deburring system using rotating wire brushes that may be moved into and out of engagement with the workpiece as desired.

A further object of the present invention is the provision of an improved deburring system which permits the positions of the rotating brushes to be adjusted to accommodate workpieces of varying shapes and sizes.

A further object of the present invention is the provision of an improved deburring system wherein a plurality of deburring brushes may be adjusted longitudinally along an axes parallel to the axis of the workpiece.

A further object of the present invention is the provision of a deburring system which permits the adjustment of the deburring brushes toward and away from the workpiece in order to accommodate the various shapes and sizes of different workpieces.

A further object of the present invention is the provision of a belt-drive system wherein the tension on the belt may be adjusted easily.

A further object of the present invention is the provision of a cylinder for moving the deburring brushes in to contact with the workpiece while at the same time permitting the deburring brushes to be pushed away from the workpiece if for some reason they engage the workpiece too aggressively.

A further object of the present invention is the provision of an improved deburring system which permits the easy removal and replacement of the drive belt for the deburring brushes.

A further object of the present invention is the provision of an improved deburring system which is economical to manufacture, durable in use, and efficient in operation.

SUMMARY OF THE INVENTION

The foregoing objects may be achieved by a deburring system comprising a frame and a workpiece. A workpiece holder on the frame detachably and movably holds the workpiece for rotation about a workpiece axis. A workpiece drive is connected to the workpiece holder and rotates the workpiece about the workpiece axis. A deburring head includes a plurality of deburring brushes each mounted to the deburring head for rotation about a brush axis. A brush drive rotates the deburring brushes about their respective brush axes. A deburring mechanism connects the deburring head to the frame for movement from an inoperative position wherein the deburring brushes are spaced from the workpiece to an operative position wherein the deburring brushes contact the workpiece during rotation of the deburring brushes and during rotation of the workpiece.

According to one feature of the invention the mounting mechanism pivotally mounts the deburring head to the frame for hinged movement about a hinge axis parallel to the workpiece axis.

According to another feature of the invention the brush axes are perpendicular to the workpiece axis.

According to another feature of the invention each of the deburring brushes are movable toward and away form the workpiece when the deburring head is in its operative position.

The foregoing objects may be achieved by a method for deburring a workpiece mounted on a workpiece holder for rotation about a workpiece axis. The method comprises rotating a plurality of deburring brushes about a plurality of brush axes respectively at an inoperative position wherein the deburring brushes are free from contact with the workpiece. In the next step of the method the rotating deburring brushes are moved from their inoperative position to an operative position in contact with the workpiece to remove burrs from the workpiece. According to the next step of the method the deburring brushes are rotated to the inoperative position after the brushes have removed the burrs from the workpiece.

According to one feature of the method the workpiece is rotated about its workpiece axis during the time that the deburring brushes are in their operative position.

According to another feature of the invention the deburring brushes are rotatably mounted to a mounting head and the mounting head is moved to cause the deburring brushes to move between their operative and inoperative positions.

According to another feature of the invention the positions of the deburring brushes are adjusted relative to the deburring head so that the deburring brushes will be in positions permitting them to contact the workpiece when the deburring brushes are in their operative position.

According to another feature of the method a predetermined force is applied to the deburring brushes for holding them in contact with the workpiece when the deburring brushes are in their operative position. The predetermined force is chosen to permit the brushes to yield and move toward the inoperative position in response to being engaged by portions of the workpiece during rotation of the workpiece.

DETAILED DESCRIPTION OF THE PREFERRED EMBODIMENT

Figure 1:
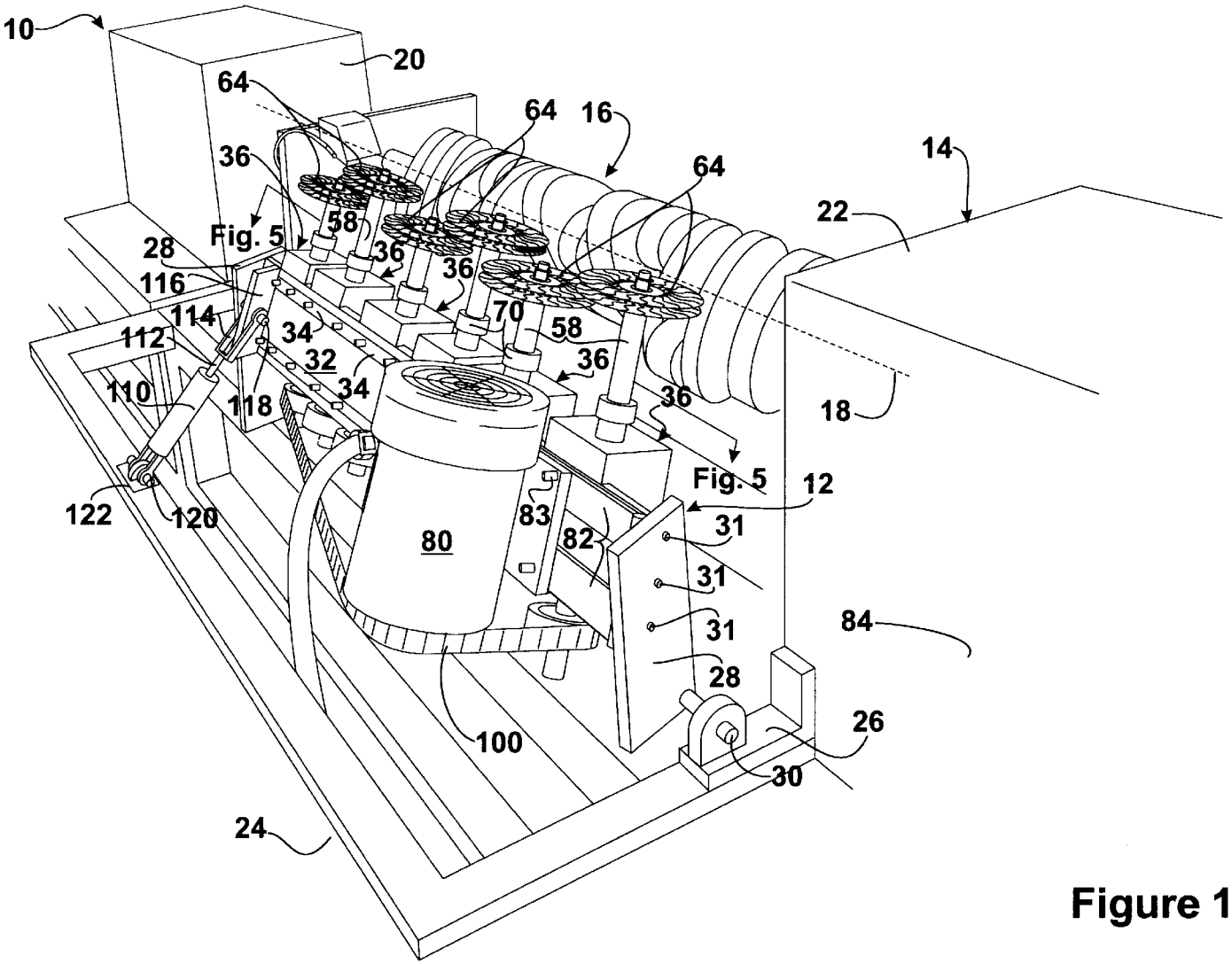
FIG. 1 is a pictorial view of the deburring system of the present invention.
Figure 3:
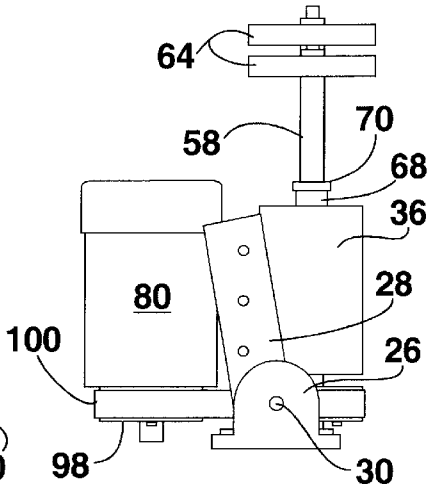
FIG. 3 is an end elevational view of the deburring head.
Figure 2:
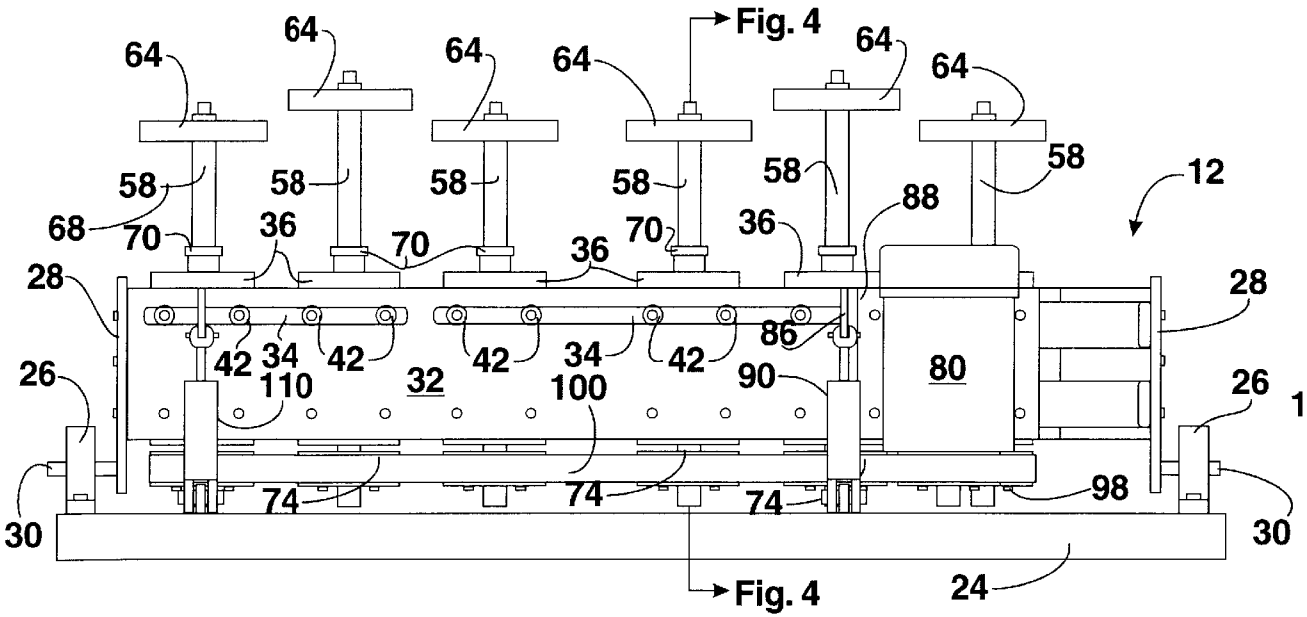
FIG. 2 is a front elevational view of the deburring head.

Referring to the drawings the numeral 10 generally designates the deburring device of the present invention. Deburring device 10 includes a deburring head 12, a frame 14, and a workpiece 16. The workpiece 16 is mounted for rotation about a workpiece axis 18 by means of a head stock frame 20 and a tail stock frame 22. Extending forwardly from head and tail stock frames 18, 20 is a U-shaped front frame 24 having a pair of spaced apart pillow blocks 26 mounted on the ends thereof. The deburring head 12 includes a pair of spaced apart flip mounting plates 28 having pivot pins 30 pivotally mounted in the pillow blocks 26. Bolted by bolts 31 to the flip mounting plates 28 is a flip plate 32. Flip plate 32 includes a plurality of longitudinally extending sliding slots 34 which are adapted to permit the longitudinal adjustment of a plurality of spindle housings 36 along the length of the flip plate 32.

Figure 4:
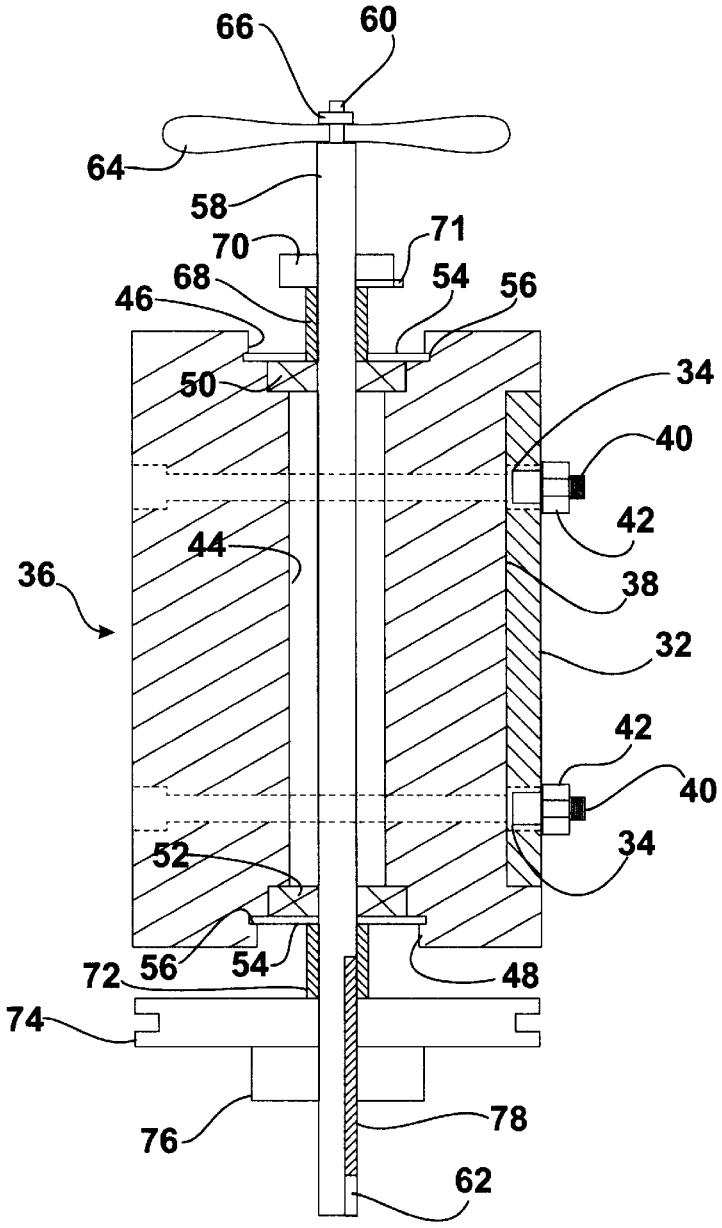
FIG. 4 is a sectional view taken along line 4—4 of FIG. 2.
Figure 4A:
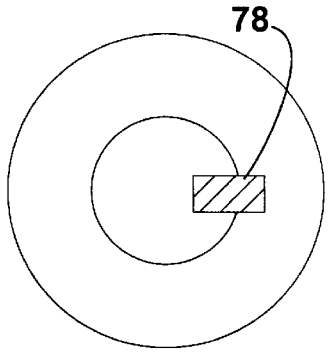
FIG. 4A is a sectional view taken transversely through FIG. 4.
Figure 5:
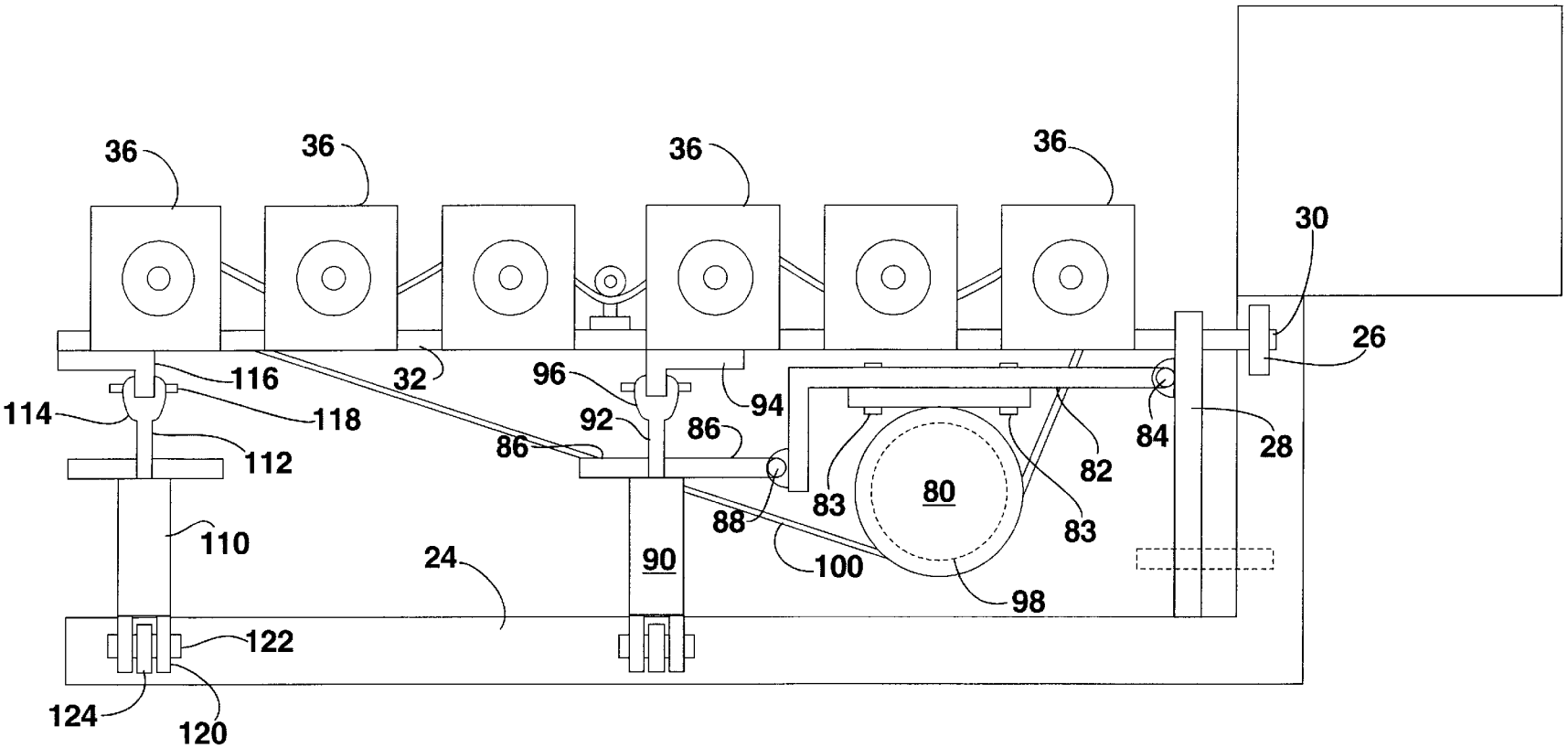
FIG. 5 is a sectional view taken along line 5—5 of FIG. 1.

As can be seen in FIG. 4 the rear surface of each spindle housing 36 includes a spindle housing channel 38 which is sized to receive the flip plate 32. This insures that the spindle housings 36 are held positively relative to the flip plate 32 and do not change their orientation with respect to the flip plate 32. A plurality of elongated bolts 40 extend through the spindle housings 36 and nuts 42 are threaded over the ends thereof to attach the flip plate 32 to each spindle housing 36.

Extending vertically downwardly through each spindle housing 36 is a spindle bore 44. At the upper and lower ends of bore 44 are an upper counter bore 46 and a lower counter bore 48 respectively. Within these counter bores are an upper bearing 50 and a lower bearing 52. The bearings 50, 52 are held in place by a retaining ring 54 which fits within a ring groove 56.

Rotatably mounted within the bearings 50, 52 is a spindle shaft 58 having a threaded upper end 60 and having a key way groove 62 on its lower end.

A deburring brush 64 is mounted over the threaded upper end 60 of spindle shaft 58 and is secured thereon by means of a nut 66.

A locking collar 70 bears against a cylindrical spacer 68 and is attached by means of a set screw 71 to the spindle shaft 58.

At the lower end of spindle shaft 58 is a spacer 72 which insures that the pulley 74 is positioned a predetermined distance from the lower edge of flip plate 32. Pulley 74 is held in place on shaft 58 by means of a key 78 fitted within key way 62. Key 78 also extends through a key way in bushing 76. Bushing 76 and the pulley 74 are fixed to the shaft 58 by means of the key 78.

A pulley drive motor 80 is secured to a motor mount arm 82 by means of bolts 83. Motor mount arm 82 is hinged to the right-hand flip mounting plate 28 for hinge movement about a hinge 84.

At the opposite end of motor mount arm 82 is mounted a cylinder mount bracket 86 which is pivoted about a bracket hinge 88 to the end of motor mount arm 82. A tensioning cylinder 90 is bolted to the cylinder mount bracket 86 and includes a cylinder rod 92 having a clevis 96 on the opposite end thereof pivotally mounted to a tensioning bracket 94 which is attached to the flip plate 32.

The lower end of motor 80 is provided with a motor pulley 98 and a pulley belt 100 is trained around the motor belt 98 and passes in a serpentine fashion around the various pulleys 74 on each of the spindle housings 36.

The cylinder 90 functions as a tensioning device. Preferably cylinder 90 is a pneumatic cylinder, and the air pressure to the cylinder is regulated to allow the tension on the belt 100 to be increased or decreased. In order to remove the belt the air is merely shut off to tensioning cylinder 90, and the air can be reintroduced after the belt has been replaced.

A flip plate cylinder 110 includes a cylinder rod 112 having a rod clevis 114 on the end thereof. The clevis is pivotally mounted to a flip plate bracket 116 which is attached to the flip plate 32. The rod clevis 114 pivots about a pin 118.

The rear end of cylinder 110 includes a cylinder clevis 120 which is pivotally mounted by means of a pin 122 to a cylinder mounting bracket 124 on the front frame member 24.

Extension of the cylinder 110 causes the deburring head 12 to pivot from an inoperative position wherein the brushes 64 are spaced away from the workpiece 16 to an operative position wherein the brushes 64 are in contact with the workpiece 16. Simultaneously the workpiece 16 is rotated about its workpiece axes 18 and the brushes 64 are rotated about the longitudinal axes of their respective spindles. The air pressure within cylinder 110 is maintained at a level which permits the brushes to yield away from the workpiece 16 in response to encountering a protrusion on the workpiece 116 while it is being rotated.

The various brushes 64 can be adjusted longitudinally with respect to the length of the flip plate 32 by loosening the nuts 42 and sliding the bolts 40 within the slots 34.

Similarly, the brushes may be moved along the longitudinal axes of the spindle shafts 58 by loosening the collars 70 and sliding the shafts longitudinally within the bearing 50. Once the desired position of the brush 64 is achieved, the key 78 is removed and the pulley 74 is moved into engagement with the spacer 72. The key is then reinserted. All of the pulleys are maintained in alignment with the belt 100 by means of the spacers 72.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A deburring apparatus comprising:

a frame;

an work piece;

a work piece holder on said frame detachably and movably holding said work piece for rotation about a rotational work piece axis;

a work piece drive connected to said work piece holder for rotating said work piece about said work piece axis;

a deburring head;

a plurality of deburring brushes each mounted to said deburring head for rotation about a brush axis;

a brush drive for rotating said deburring brushes about their respective brush axes, wherein said brush axes are perpendicular to said work piece axis;

a deburring mounting mechanism connecting said deburring head to said frame for movement from an inoperative position wherein said deburring brushes are spaced from said work piece to an operative position wherein said deburring brushes contact said work piece during rotation of said deburring brushes and during rotation of said work piece.

2. A deburring apparatus according to claim 1 wherein said mounting mechanism pivotally mounts said deburring head to said frame for hinged movement about a hinge axis which is parallel to said work piece axis.

3. A deburring apparatus according to claim 2 wherein said brushes are each mounted on an elongated brush shaft having a longitudinal brush shaft axis, said brush shafts each being adjustably mounted to said deburring head for adjustable movement of said brushes toward and away from said work piece when said deburring head is in said operative position.

4. A deburring apparatus according to claim 3 wherein said work piece is a crank shaft for an internal combustion engine.

5. A method for deburring a work piece mounted on a work piece holder for rotation about a work piece axis, said method comprising:

rotating a plurality of deburring brushes about a plurality of brush axes, respectively, at an inoperative position wherein said deburring brushes are free from contact with said work piece;

moving said rotating deburring brushes from said inoperative position to an operative position in contact with said work piece to remove burrs from said work piece; maintaining said brush axes in a direction which is perpendicular to said work piece axis when said deburring brushes are in said operative position;

moving said rotating deburring brushes to said inoperative position after said brushes have removed said burrs from said work piece.

6. A method according to claim 5 and further comprising rotating said work piece about said work piece axis during the time that said deburring brushes are in said operative position.

7. A method according to claim 6 and further comprising mounting said deburring brushes to a mounting head for rotation about said brush axes.

8. A method according to claim 7 and further comprising moving said mounting head to cause said deburring brushes to move between said operative position and said inoperative position.

9. A method according to claim 8 and further comprising adjusting the positions of said deburring brushes relative to said deburring head so that said deburring brushes will be in positions permitting them to contact said work piece when said deburring brushes are in said operative position.

10. A method according to claim 8 and further comprising applying a predetermined force for holding said deburring brushes in contact with said work piece when said deburring brushes are in said operative position, said predetermined force being chosen to permit said brushes to yield and move toward said inoperative position in response to being engaged by portions of said work piece during rotation of said work piece.

* * * * *